United States Patent [19]

Stokes

[11] Patent Number: 4,531,890

[45] Date of Patent: Jul. 30, 1985

[54] CENTRIFUGAL FAN IMPELLER

[76] Inventor: Walter S. Stokes, 2336 Lu Field Rd., Dallas, Tex. 75229

[21] Appl. No.: 460,249

[22] Filed: Jan. 24, 1983

[51] Int. Cl.[3] ..... F04D 29/30

[52] U.S. Cl. ..... 416/187; 416/242

[58] Field of Search ..... 416/180, 182, 186 R, 416/187, 242, 243; 415/115

[56] References Cited

U.S. PATENT DOCUMENTS

| | | | |
|---|---|---|---|
| 912,133 | 2/1909 | Kellogg | 416/186 |
| 2,975,962 | 3/1961 | Busquet | 415/115 |
| 3,697,193 | 10/1972 | Phillips | 416/242 |
| 4,231,706 | 11/1980 | Ueda et al. | 416/186 R |

FOREIGN PATENT DOCUMENTS

| | | | |
|---|---|---|---|
| 814564 | 7/1959 | United Kingdom | 416/186 |

*Primary Examiner*—Henry C. Yuen
*Assistant Examiner*—John Kwon
*Attorney, Agent, or Firm*—Crutsinger, Booth & Ross

[57] ABSTRACT

Centrifugal fans are provided comprising impellers having backward inclined blades that are cambered radially inward and that are inclined at an angle less than about 40° relative to the tangential direction of the midpoint of a chord connecting the leading and trailing edges of each blade.

2 Claims, 5 Drawing Figures

CENTRIFUGAL FAN IMPELLER

TECHNICAL FIELD

This invention relates to fans, and more particularly, to centrifugal fans having an improved impeller design. The impeller and blade configuration disclosed herein is adapted to reduce fan noise and provide increased fan efficiency when compared to the centrifugal fans previously known.

BACKGROUND OF THE INVENTION

Fans are commonly classified as either axial or centrifugal, depending upon the direction in which air is discharged by the fan blades relative to the rotational axis of the impeller. In axial flow fans the air is discharged in a direction substantially parallel to the axis of the impeller, whereas in centrifugal fans, the air is discharged in a substantially radial direction. The present invention relates to an improved impeller and blade design for centrifugal fans.

Centrifugal fans are subclassified in the literature according to their impeller and blade designs. The impeller and blade designs employed in the commercially available centrifugal fans are the airfoil, backward inclined, radial, modified radial, and forward curved. Of these, the airfoil type has been recognized as being the most efficient. The airfoil type centrifugal fan incorporates a plurality of impeller blades which, in cross section, have a shape like an airfoil. The blades are circumferentially spaced around the impeller and are backward inclined. As used herein, the term "backward inclined" means that each blade slopes backwards from the direction of rotation in such manner that the heel of each blade is radially inward of its tip and is forward of the tip relative to the direction of rotation. In centrifugal fans employing airfoil blades, the common practice until now has been to construct and mount the blades so that the convex, or high camber, side of the airfoil faces radially outward. However, two problems have been observed with the airfoil fans constructed in this manner. First, because the blades are backward inclined relative to the direction of rotation with the high camber side of the airfoil facing radially outward, a negative angle of attack is created between the leading edge of the airfoil and the impinging air, thereby reducing the aerodynamic efficiency of the impeller. Second, the natural aerodynamic forces cause the airstream across the inward facing or lower pressure side of the blade to separate from the blade prior to reaching the trailing edge, thereby causing turbulence and undesirable fan noise.

The impellers of the backward inclined centrifugal fans are similarly designed, except that the blades are made of a single thickness of metal, and both the outward and inward facing blade surfaces have substantially the same curvature. The single thickness, backward inclined blades are usually flat, but may be curved, in which case the convex or high camber side of the blades also faces radially outward. These backward inclined centrifugal fans suffer from the same disadvantages as the airfoil fans previously discussed.

In the radial and modified radial fans, the heel and tip of each blade are radially aligned, and the blades comprise a single metal thickness. In the radial fans the blades are planar; in the modified radial fans, each blade is cambered radially inward between the heel and tip, and thus, away from the direction of rotation. Aerodynamically, the radial and modified radial fans are less efficient than either the airfoil or backward inclined fans.

With forward curved fans, the impeller blades typically have a constant thickness and are concave relative to the direction of rotation. However, unlike either the backward inclined or modified radial fans, the tip of each blade extends forward of its heel. Forward curved fans are also less efficient than the airfoil fans.

SUMMARY OF THE INVENTION

According to the present invention, an improved centrifugal fan impeller is provided that is characterized by increased aerodynamic efficiency and lower fan noise.

According to a preferred embodiment of the invention, a centrifugal fan impeller having cambered blades is provided wherein the blades are backward inclined from heel to tip relative to the rotational direction of the impeller.

According to another preferred embodiment of the invention, a centrifugal fan impeller having backward inclined, cambered blades is provided wherein the blades have an incidence angle of less than about 40°.

According to another preferred embodiment of the invention, a centrifugal fan impeller having backward inclined airfoil blades is provided wherein the mean camber of the blades, when viewed in cross section, and when measured from a straight line from the leading edge to the trailing edge, is higher on the side of the blade that faces radially inward.

BRIEF DESCRIPTION OF THE DRAWINGS

The apparatus of the invention is further described and explained in relation to the following drawings wherein.

Like numerals are used to designate like parts in the various figures of the drawings.

DESCRIPTION OF THE PREFERRED EMBODIMENTS

Figure 1:
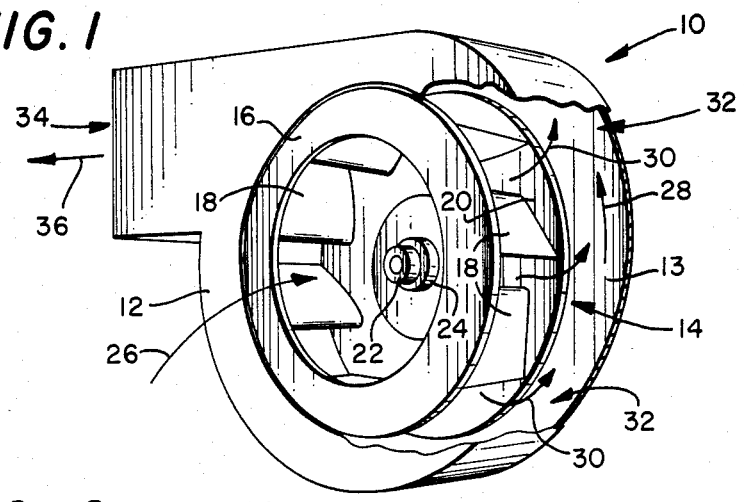
FIG. 1 is a perspective view, partially broken away, of a centrifugal fan suitable for use with the impeller and blade design disclosed herein.

Referring to FIG. 1, centrifugal fan 10 comprises scroll 12 having impeller 14 disposed therein. It is to be understood, however, that the improved impeller and blade design disclosed herein can also be utilized without a scroll in some applications, and is similarly effective when used in that manner. Impeller 14 further comprises shroud 16, blades 18 and backplate 20. Impeller 14 is desirably mounted in fixed relation to rotatable shaft 22 by means of cylindrical collar 24, which is in turn concentrically aligned with and rotatably mounted in a centrally disposed bore in backwall 13 of scroll 12.

During operation of centrifugal fan 10, air is drawn into the fan through shroud 16 as shown by streamline 26 and is thereafter acted upon by blades 18 as impeller 14 rotates in the direction shown by arrow 28. As blades 18 continue to rotate, the air flows outwardly from between them as shown by streamlines 30 into cavity 32 that exists between the exterior of impeller 14 and the interior of scroll 12. Where no scroll is utilized, the air is exhausted radially into the surrounding atmosphere. The air continues to travel through cavity 32 in the direction shown by arrow 28 until it is discharged through outlet 34 of scroll 12 as shown by streamline 36. In most applications, scroll 12 and impeller 14 are constructed from sheet metal which has been shaped and fastened by welding, riveting, or the like, into the desired configuration. Rotatable shaft 22 can be drive by any conventional drive means that is well known to those of ordinary skill in the art.

Figure 2:
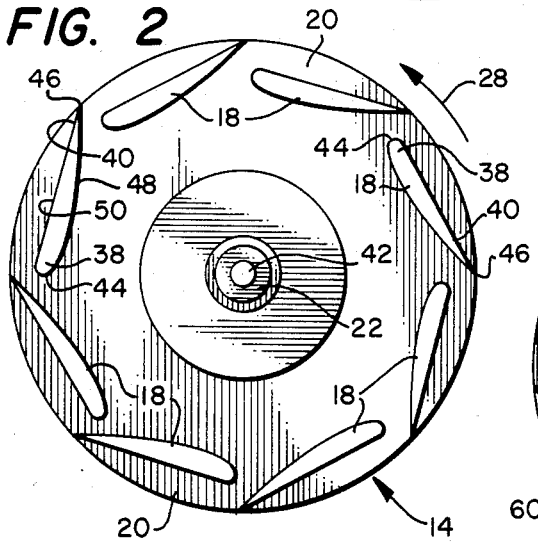
FIG. 2 is a front elevation view of an impeller suitable for use in the fan of FIG. 1, but having its shroud removed so as to better illustrate the cross sectional shape of the fan blades and their angular relationship to the backplate of the impeller.
Figure 3:
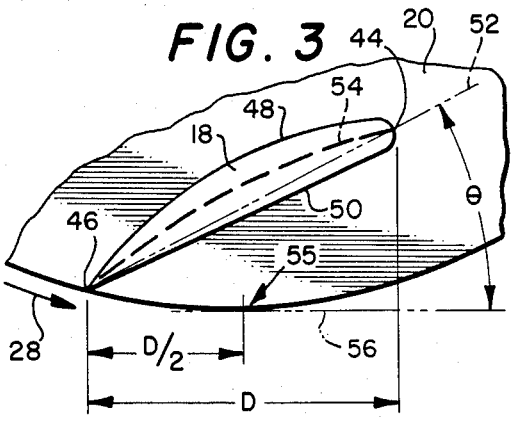
FIG. 3 is a detail view of a portion of the impeller shown in FIG. 2 wherein one of the blades is enlarged for the purpose of further describing its shape and configuration.

Having generally described the construction and operation of a centrifugal fan 10 suitable for use with the present invention, a preferred embodiment of the improved impeller configuration and blade design is further described in relation to FIGS. 2 and 3. FIG. 2 depicts backplate 20 of impeller 14 as shown in FIG. 1, which is rotated by rotatable shaft 22 in the direction shown by arrow 28. A plurality of blades 18 are attached at their distal ends to backplate 20 and at their proximal ends to shroud 16. Blades 18 are connected to shroud 16 and backplate 20 by conventional means.

In FIG. 2, shroud 16 is removed in order to better illustrate the cross section of blades 18. Each blade 18 further comprises heel 38 and tip 40. Heel portion 38 of blade 18 is disposed relatively nearer to central axis 42 through rotatable shaft 22 than is tip portion 40. According to a preferred embodiment of the invention, blades 18 are backwardly inclined relative to the direction in which backplate 20 of impeller 14 rotates. When blades 18 are inclined in this manner, leading edge 44 is the most forward extending portion of heel 38, and trailing edge 46 is the most rearward extending portion of tip 40. The low pressure surface 48 of each blade 18 is the inward facing surface extending between leading edge 44 and trailing edge 46. Conversely, the high pressure surface 50 is the outward facing surface extending between leading edge 44 and trailing edge 46. Generally speaking, the low and high pressure sides of blades 18 are the air flow channels adjacent to low pressure surface 48 and high pressure surface 50, respectively.

Impeller 14 can be constructed in such manner that shroud 16 and backplate 20 are spaced further apart at the point adjacent heel 38 than at the point adjacent tip 40 of each blade 18, in which case the trailing edge 46 of each blade 18 will be narrower when measured from shroud 16 to backplate 20 than will leading edge 44. By narrowing the width of blades 18 near the outside diameter of impeller 14, it is possible to increase the velocity of the air discharged by the fan at a given rate of rotation.

The significant improvements in efficiency and noise reduction that are attainable through use of the present invention are further explained in relation to the detail view shown in FIG. 3. Referring to FIG. 3, chord 52 connects leading edge 44 and trailing edge 46 of blade 18. The tangential component of chord 52 extends a distance D in the tangential direction from trailing edge 46. Reference line 56 is drawn tangent to backplate 20 at point 55, which is disposed radially outward from the midpoint of chord 52. The angular relationship between chord 52 of blade 18 and reference line 56 is referred to as the incidence angle $\theta$. According to the present invention, particularly desirable results are achieved when the incidence angle is less than about 40°. The preferred incidence angle for a particular fan will further depend upon the design speed of the fan and the static pressure against which it operates. Thus, an incidence angle of about 40° may be satisfactory for a fan designed to operate at low speeds against a low static pressure; whereas, an incidence angle considerably less than 40° is preferred for a fan designed to operate at high speeds against a high static pressure.

Similarly, the preferred camber also varies according to the design fan speed and static pressure. Dashed line 54 in FIG. 3 depicts the line of mean camber between low pressure surface 48 and high pressure surface 50 of blade 18 when backplate 20 is rotated in the direction shown by arrow 28. According to the present invention, blades 18 are preferably adapted in such manner that the highest camber occurs in the forward half of each blade and is directed toward the low pressure side. Furthermore, the line of mean camber in the forward half of each blade preferably lies on the low pressure side of chord 52. When blades 18 are built in accordance with these parameters, and are connected to shroud 16 and backplate 20 of impeller 14 so that the incidence angle is controlled within the limitations previously disclosed, the airflow on the low pressure side of blades 18 will be substantially laminar, thereby increasing fan efficiency and decreasing fan noise.

Within the foregoing limitations, the height of the camber and the point along the chord of the blade at which the maximum camber occurs can vary, these also being considerations in designing fans for various static pressures and radial speeds. Likewise, the number of blades and the chord length of the blades relative to the diameter of the impeller can vary with the intended function of the fan. Typically, adjacent blades are disposed in close enough proximity around the periphery of impeller 14 that the heel 38 of one blade and tip 40 of the nearest adjacent blade will overlap. This results in somewhat of a cascade effect as air passes between the adjacent blades.

It is also within the scope of the present invention to employ blades of the type disclosed herein in combination with blades having different configurations on a common impeller.

Figure 4:
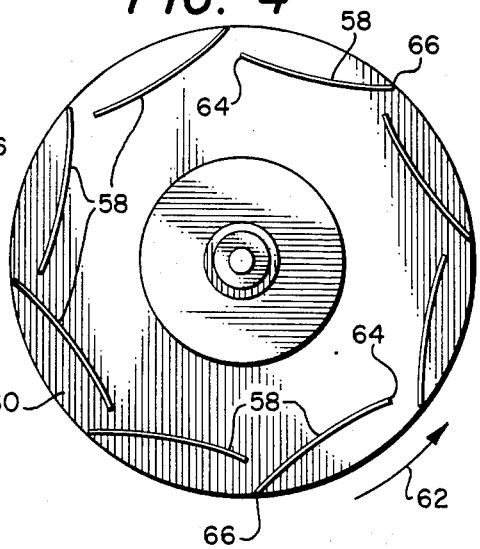
FIG. 4 is a front elevation view of an alternate embodiment of the invention wherein the blades attached to the backplate of the impeller have a cross section of constant thickness rather than being airfoil shaped as in FIG. 2.

According to another preferred embodiment of the invention, as shown in FIG. 4, similarly unexpected and beneficial results are obtained when blades 58 having a single thickness are substituted for the airfoil type blades 18 of FIG. 2. In this case, however, the design limitations previously discussed in relation to FIGS. 2 and 3 must also apply to single thickness blades 58. Thus, blades 58 should be backwardly inclined from the direction of rotation of backplate 60, as shown by arrow 62. Furthermore, the incidence angle between the chords extending from leading edges 64 to trailing edges 66 of blades 58 should be less than about 40°. Finally, the curvature of the single thickness blades 58 should be such that the line of means camber lies on the low pressure side of the chord of each blade and that the maximum camber occurs in the first half of the blade on the low pressure side.

Figure 5:
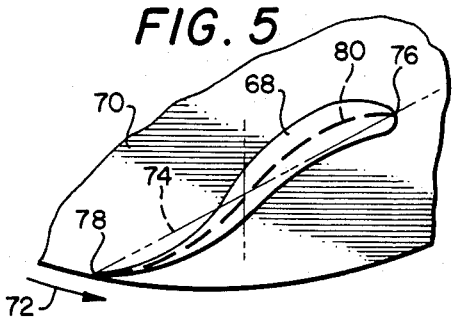
FIG. 5 is a front elevation view of an alternate embodiment of the invention wherein the blades have a recurved cross-sectional shape of varying thickness wherein the forward half of the blade is cambered toward its low pressure side.

In the embodiment shown in FIGS. 2, 3 and 4, the line of mean camber lies on the low pressure side of the chord over its entire length. However, as shown in FIG. 5, blades can also be designed within the scope of the invention in which the line of mean camber in the trailing half of the blade lies either partially or entirely on the high pressure side. Such a design may be desirable in some instances in order to better control the airflow exiting the impeller. However, in such instances it is still preferred that the maximum camber occur in the forward half of the blade and in the direction of the low pressure side.

Referring to FIG. 5, a plurality of recurved blades 68 are circumferentially spaced around backplate 70, which rotates in the direction shown by arrow 72. Each blade 68 further comprises a chord 74 extending between its leading edge 76 and trailing edge 78. Dashed line 80, which is the line of mean camber, lies on the low pressure side of chord 74 in the forward half of blade 68, but lies on the high pressure side of chord 74 in the trailing half of blade 68. Further, as previously discussed in relation to FIG. 3, the incidence angle between chord 74 and the tangential direction of the midpoint of chord 74 when backplate 70 is rotated in the direction shown by arrow 72 is preferably less than about 40°.

Other alterations and modifications of the present invention will become apparent to those of ordinary skill in the art upon reading the specification and reviewing the accompanying drawings, and it is intended to cover all such alterations and modifications as fall within the scope of the appended claims.

What is claimed is:

1. A centrifugal fan comprising an impeller and means for rotating said impeller, said impeller further comprising a plurality of circumferentially spaced apart, backward inclined blades, said blades being cambered radially inward so as to provide substantially laminar flow on the low pressure side of said blades when said impeller is rotated, said blades further comprising a leading edge and a trailing edge, and being disposed relative to the direction of rotation in such manner that the chord extending between the leading and trailing edges of each of said blades is disposed at an angle of less than about 40° relative to the tangential direction at the midpoint of said chord when said impeller is rotated, said blade further comprising a first surface that extends from said leading edge to said trailing edge on the low pressure side of said blade, a second surface that extends from said leading edge to said trailing edge on the high pressure side of said blade, with the maximum camber of said first surface occurring in the forward extending half of said surface, and with the line of mean camber between the forward extending half of said first surface and the forward extending half of said second surface being itself cambered radially inward from the chord extending between said leading edge and said trailing edge.

2. A centrifugal fan comprising an impeller and means for rotating said impeller, said impeller further comprising a plurality of circumferentially spaced apart, backward inclined blades, said blades being cambered radially inward so as to provide substantially laminar flow on the low pressure side of said blades when said impeller is rotated, said blades further comprising a leading edge and a trailing edge, and being disposed relative to the direction of rotation in such manner that the chord extending between the leading and trailing edges of each of said blades is disposed at an angle of less than about 40° relative to the tangential direction at the midpoint of said chord when said impelller is rotated, said blade further comprising a first surface that extends from said leading edge to said trailing edge on the low pressure side of said blade, a second surface that extends from said leading edge to said trailing edge on the high pressure side of said blade, with the maximum camber of said first surface occurring in the forward extending half of said surface, and with the line of mean camber between the forward extending half of said first surface and the forward extending half of said second surface being itself cambered radially inward from the chord extending between said leading edge and said trailing edge, wherein at least a portion of the line of mean camber between the rearward extending half of said first surface and the rearward extending half of said second surface lies radially outward of the chord extending between said leading edge and said trailing edge and is cambered radially outward relative to said chord.

* * * * *

UNITED STATES PATENT AND TRADEMARK OFFICE

CERTIFICATE OF CORRECTION

PATENT NO. : 4,531,890

DATED : July 30, 1985

INVENTOR(S) : Walter S. Stokes

It is certified that error appears in the above-identified patent and that said Letters Patent is hereby corrected as shown below:

In Column 3, line 23, delete "drive" and insert -- driven --.

Signed and Sealed this

*Twenty-second* Day of *October 1985*

[SEAL]

*Attest:*

DONALD J. QUIGG

*Attesting Officer*

*Commissioner of Patents and Trademarks—Designate*